United States Patent [19]

Boucheron

[11] Patent Number: 5,076,073

[45] Date of Patent: Dec. 31, 1991

[54] JEWEL WITH INTERCHANGEABLE COMPONENT ELEMENTS

[75] Inventor: Alain Boucheron, Paris, France

[73] Assignee: Boucheron Development International, Amsterdam, Netherlands

[21] Appl. No.: 477,911

[22] PCT Filed: Oct. 28, 1988

[86] PCT No.: PCT/FR88/00535

§ 371 Date: Apr. 30, 1990

§ 102(e) Date: Apr. 30, 1990

[87] PCT Pub. No.: WO89/03646

PCT Pub. Date: May 5, 1989

[30] Foreign Application Priority Data

Oct. 30, 1987 [FR] France ..... 87 15122

[51] Int. Cl.[5] ..... A44C 17/02

[52] U.S. Cl. ..... 63/29.1; 63/28; 63/15.4

[58] Field of Search ..... 63/1.1, 2, 3, 11, 28, 63/15.5, 15.4, 15.3

[56] References Cited

U.S. PATENT DOCUMENTS 1,586,606 6/1926 Cain ..... 63/15.4 X
1,747,586 2/1930 Joel ..... 63/29.1 X
1,866,320 7/1932 Roskin ..... 63/15.4
2,151,607 3/1939 Lovell .

FOREIGN PATENT DOCUMENTS 13049 of 1880 Fed. Rep. of Germany .
2428174 1/1976 Fed. Rep. of Germany .
2448874 10/1980 France ..... 63/28
2563708 11/1985 France .
2581295 11/1986 France .

*Primary Examiner*—Laurie K. Cranmer
*Attorney, Agent, or Firm*—Beveridge, DeGrandi & Weilacher

[57] ABSTRACT

A jewel is formed from a plurality of components and comprises two mutually complementary elements, one of which forms a base and the other an insert. Both elements are incurved and at least one is not completely closed. The base has at least one window which crosses it from the concave side to the convex side and the insert has at least one protuberance complementary to the window of the base. Assembly of the two elements by penetration of the protuberance into the window of the base necessitates an elastic deformation of at least one of the two elements. At least one of the elements is interchangeable, which allows the appearance of the jewel to be changed.

15 Claims, 2 Drawing Sheets

JEWEL WITH INTERCHANGEABLE COMPONENT ELEMENTS

The present invention relates to a jewel formed from a plurality of component elements of which at least one is interchangeable.

In general, a jewel consists of a single element formed by a material or an assembly of a plurality of materials of different appearances, and it may or it may not have a movable part for making it easier to fit in it. Convertible jewels consisting of a set of elements are also known, for example a tiara convertible into a necklace by subtracting a particular number of elements, each of which is a jewel, another example being a necklace pendant which can be detached to become a garment lapel brooch.

The object of the present invention is to provide a jewel of variable appearance.

According to the invention, this object is achieved with a jewel composed of a plurality of elements, of which at least one is interchangeable, allowing a change of appearance of the jewel as a whole. According to the invention, the jewel comprises at least two mutually complementary elements, one forming a base and the other an insert, both being of curved form and at least one not being closed on itself. The base has at least one aperture passing through the base from the concave side to the convex side, and the insert has at least one protuberance complementary to the aperture of the base, so that assembling the two elements together as a result of the penetration of the protuberance of the insert into the aperture of the base requires a slight elastic deformation of at least one of the two elements.

According to a preferred embodiment of the invention, the jewel is composed of two elements: a base and an insert. The insert is of a width smaller than that of the base and has protuberances along the curvature on its convex surface; moreover, it has an open form, that is to say it is not closed on itself. The base has at least one aperture, the orifice of which is larger than the maximum cross-section of the insert, so that the latter can be introduced through this aperture from the convex side of the base to the concave side before it is assembled with this. The assembling and dismantling of these two elements are carried out by means of a slight pressure on the insert and the base. The insert or the base can therefore be replaced by another equivalent element having another appearance, in order to change the appearance of the jewel as a whole.

Another preferred embodiment of the invention is a jewel composed of a base having a plurality of rows of apertures distributed over the width, and an equivalent number of inserts of a width smaller than that of the row of corresponding apertures. This makes it possible to vary the appearance of the jewel even more, since the combination of the various inserts and the base can be influenced.

This type of jewel has a definite advantage over conventional jewels. The present invention, as a result of the easy substitution of at least one of the component elements, makes it possible to provide a jewel of an appearance variable according to the particular circumstances of use, making it possible, for example, to adapt the jewel to the particular style of dress by selecting the different geometrical forms, materials, structures, colors, etc. of the interchangeable part or parts.

Other characteristics and advantages of the invention will emerge more clearly from the following description given purely as an illustration and in a nonlimiting way. The description refers to the accompanying drawings in which.

Figure 1:
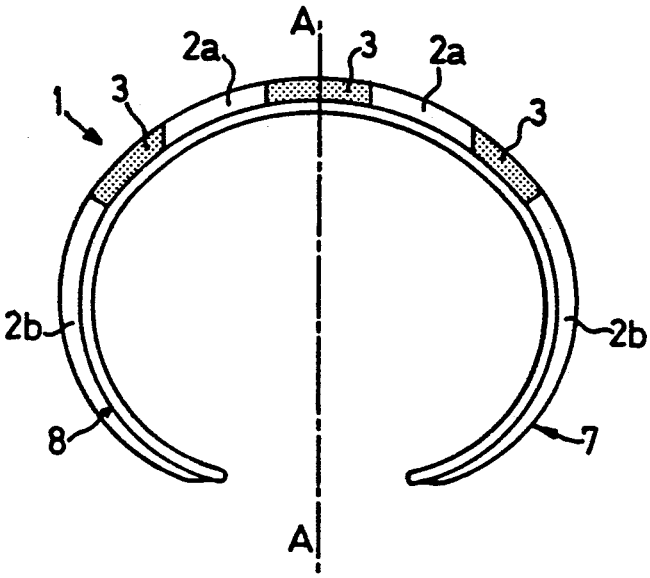
FIG. 1 shows a front view of a bracelet according to the invention.

FIGS. 1 to 4 illustrate a bracelet 1 according to the invention, composed of two mutually complementary component elements, of which one is a base 8 and the other an insert 7. The insert 7 and the base 8 each have a substantially elliptic form of the same curvature of an arc greater than 180° and each have a discontinuity, so that the bracelet 1 can be fitted on arms of different cross-sections as a result of slight plastic deformation. The bracelet 1 has a plane of symmetry A—A equidistant from the ends and coinciding with the minor axis of the said elliptic forms. The base 8 and the insert 7 each have a substantially constant width which decreases very slightly towards their ends. The base 8 possesses four apertures 5*a*, 5*b* and three toroidal decorative portions 3 distributed along the curvature; the two apertures 5*b* near the ends have a length two to three times greater than that of the two remaining apertures 5*a*. The insert 7 has four protuberances 2*a*, 2*b* of a toroidal surface complementary to the surfaces 3 of the base 8, and three strips 4 connecting the protuberances 2 to one another along the curvature.

Figure 2:
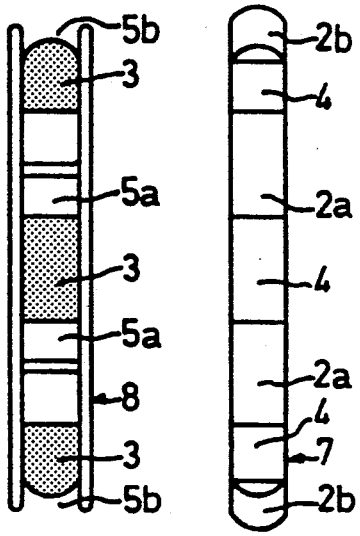
FIG. 2 shows a side view of the separate base and insert of the bracelet of FIG. 1.
Figure 3:
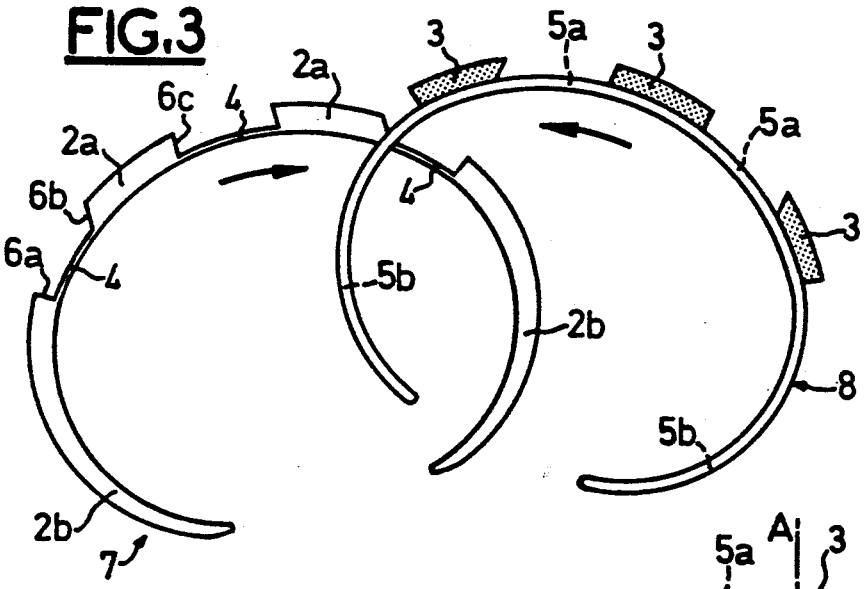
FIG. 3 shows a front view of the bracelet of FIG. 1, with the insert partially introduced into one of the apertures of the base.
Figure 4:
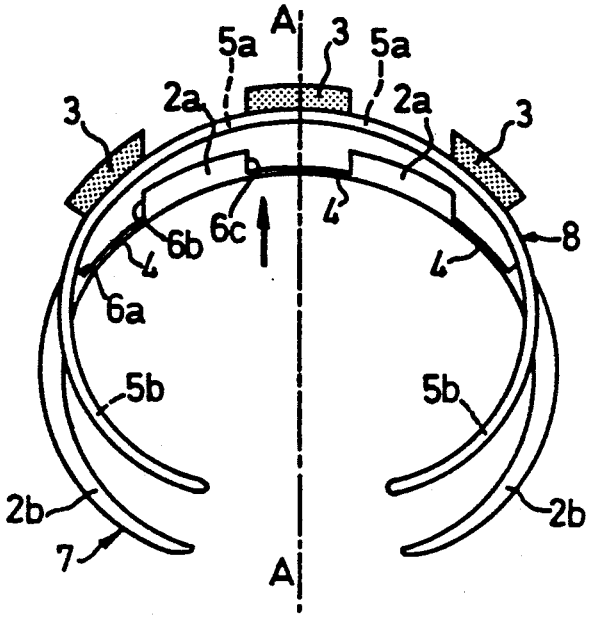
FIG. 4 shows a front view of the bracelet of FIG. 3, with the insert in position before it is assembled with the base.

According to FIG. 2, the width of the insert 7 is slightly smaller than that of the aperture 5 of the base 8. In FIG. 3, the insert 7 is introduced, through one of the apertures 5*b* near the ends of the base, in the direction indicated by an arrow, in order to assume the configuration of FIG. 4, where the end of the insert 7 introduced (according to FIG. 3) reemerges through an aperture 5*b* symmetrical relative to the preceding one, so that the two protuberances 2*a* distant from the ends are opposite the two receiving apertures 5*a*. The flanks 6*a* and 6*c* of the protuberances 2*b*, 2*a* are substantially perpendicular relative to the curvature, and the flanks 6*b* of the protuberances 2*a* are substantially parallel to the axis of symmetry A—A, so as to make it easier to assemble and dismount the two elements 7 and 8 simply as a result of a translational movement parallel to the axis of symmetry A—A, as indicated in FIG. 4. In FIG. 1, the elements 7 and 8 are assembled together, and the elastic deformations of the two elements 7 and 8 make it possible, on the one hand, to hold together the assembly of the insert 7 and of the base 8 by means of a compressive force of the apertures on the protuberances and, on the other hand, additionally to lock the ends of the insert 7 on the end edges of the apertures 5*b* of the base 8. The two elements 7 and 8 are dismounted by means of pressure exerted on the protuberances 2*a*, parallel to the axis of symmetry A—A; the release of the two elements 7 and 8 is then obtained when the pressure exerted is higher than the elastic stresses locking these two elements, and the insert 7 can subsequently be removed through one of the apertures 5b of the base 8. The insert (or the base) can consequently thereby be changed in order to change the appearance of the bracelet. Since the bracelet is worn on the arm, if an accidental impact on the bracelet releases the two component elements their mutually complementary form and structure make it possible to avoid any risk of falling.

Figure 5:
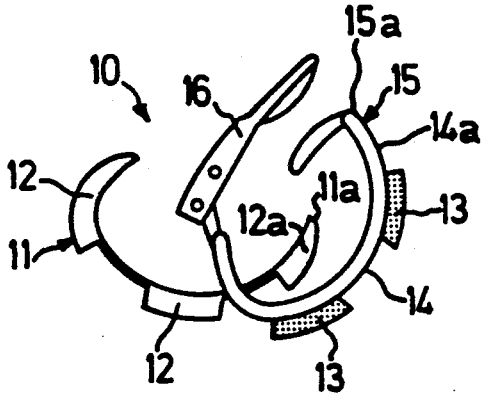
FIG. 5 shows a front view of an ear-clip with the insert partially introduced into one of the apertures of the base.
Figure 6:
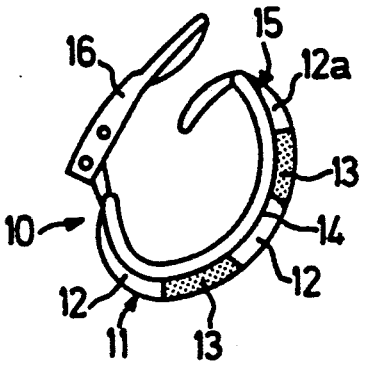
FIG. 6 shows a front view of the ear-clip of FIG. 5, with the insert in position before it is assembled with the base.

FIGS. 5 and 6 illustrate an ear-clip 10 comprising a gripper 16 mounted on the base 15. The insert 11 having three protuberances 12 is introduced via the end having a first protuberance 12a into one of the three apertures 14 of the base 15, at the end where the gripper 16 is fastened. The introduced end 11a of the insert 11 first comes into place in the aperture 14a at the other end 15a of the base 15. The lateral surfaces of the protuberances of the two ends of the insert 11 are substantially perpendicular relative to the curvature, and the two lateral surfaces of the protuberance located at the center of the insert 11 are fashioned in such a way that assembly takes place by means of pressure exerted on the other end of the insert 11, so that the latter executes a pivoting movement about the first end 11a locked on the edge of the aperture 14a. The assembly is held together (FIG. 6) as a result of the elastic deformation of the two elements 11 and 15. These two elements are dismantled by means of a pressure which causes the insert 11 to pivot about its first end 11a, and the insert 11 is separated from the base 15 by removing it through one of the apertures of the latter. The ear-clip 10 is retained by the ear lobe against any risk that the insert 11 accidentally released from the base 15 will fall.

It goes without saying that the foregoing description has been given only purely as an illustration and in a non-limiting way, and that alternative versions or modifications can be made to it within the scope of the present invention. The invention can be used for other types of jewel, for example a ring or an earring. Other alternative versions can be considered, and for example the base can have one aperture or a plurality of rows of apertures distributed over its width, and the number of inserts can vary according to the number of rows of apertures.

I claim:

1. A jewel comprising at least two mutually complementary elements, one forming a base and the other an insert, both elements being of curved form with an inner concave side and an outer convex side and at least one of said elements not being closed on itself, said base having at least one aperture passing through from its concave side to its convex side, said insert having at least one protuberance at its convex side or at its concave side and complementary to the aperture of the base, said complementary elements being assembled together by penetration of said protuberance into said aperture, requiring an elastic deformation of at least one of said elements.

2. A jewel according to claim 1, wherein said complementary elements in an assembled position are locked together by means of an elastic deformation of two ends of said element not closed on itself.

3. A jewel according to claim 1, wherein said protuberance of the insert presents flanks so shaped as to allow translational movement of the insert in relation to the base for the assembling and dismantling of the insert and the base.

4. A jewel according to claim 1, wherein said protuberance of the insert presents flanks so shaped as to allow a pivoting movement of the insert in relation to the base for the assembling and dismantling of the insert and the base, the pivoting movement being about one end of said element not closed on itself.

5. A jewel according to claim 1, wherein said element not closed in itself is the insert.

6. A jewel according to claim 1, wherein said base has at least one aperture with an orifice larger than the maximum cross-section of the insert, so that the latter can be introduced through said aperture before assembling with the base.

7. A jewel according to claim 1, wherein said element not closed on itself extends over an arc of more than 180°.

8. A jewel according to claim 1, wherein said jewel constitutes a bracelet.

9. A jewel according to claim 1, wherein said jewel constitutes a ring.

10. A jewel according to claim 1, wherein said jewel constitutes an earring.

11. A jewel according to claim 1, wherein said jewel constitutes an ear-clip.

12. A jewel according to claim 1, wherein said jewel constitutes a necklace.

13. A jewel comprising an insert and a base, both being of curved form with an inner concave side and an outer convex side and not closed on itself, said base having at least one aperture passing through from its concave side to its convex side, said insert having at least one protuberance on its convex side allowing the penetration of the protuberance into the aperture of the base from its concave side to its convex side, said base and insert being assembled and locked together by means of an elastic deformation of two ends of the insert against the base.

14. A jewel according to claim 13, wherein said base has at least one aperture with an orifice larger than the maximum cross-section of the insert, so that the latter can be introduced through said aperture before assembling with the base.

15. A jewel comprising at least two mutually complementary elements, one forming a base and the other an insert, both elements being of curved form with an inner concave side and an outer convex side and at least one of said elements not being closed on itself, said base having at least one aperture passing through from its concave side to its convex side, said insert having at least one protuberance at its convex side or at its concave side and complementary to the aperture of the base, said complementary elements being assembled together by penetration of said protuberance into and through said aperture so as to visibly present said protuberance on said convex side of said base, the assembling requiring an elastic deformation of at least one of said elements.

* * * * *